US010264356B2

(12) United States Patent
Kim et al.

(10) Patent No.: US 10,264,356 B2
(45) Date of Patent: Apr. 16, 2019

(54) METHOD OF PROCESSING SOUND SIGNAL OF ELECTRONIC DEVICE AND ELECTRONIC DEVICE FOR SAME

(71) Applicant: Samsung Electronics Co., Ltd., Gyeonggi-do (KR)

(72) Inventors: Ki-Won Kim, Gyeonggi-do (KR); Han-Ho Ko, Gyeonggi-do (KR); Joon-Rae Cho, Seoul (KR); Ki-Won Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/840,896

(22) Filed: Dec. 13, 2017

(65) Prior Publication Data

US 2018/0167732 A1 Jun. 14, 2018

(30) Foreign Application Priority Data

Dec. 13, 2016 (KR) ..... 10-2016-0169517

(51) Int. Cl.

*H04R 3/04* (2006.01)
*H04R 3/00* (2006.01)
*H04R 29/00* (2006.01)

(52) U.S. Cl.

CPC ..... *H04R 3/04* (2013.01); *H04R 3/00* (2013.01); *H04R 3/007* (2013.01); *H04R 29/00* (2013.01); *H04R 29/001* (2013.01); *H04R 2499/11* (2013.01)

(58) Field of Classification Search

CPC ..... H04R 3/04; H04R 3/007; H04R 29/001; H04R 2499/11; H04R 3/00; H04R 29/00

USPC ... 381/55, 95, 111, 114, 173, 174, 178, 386, 381/191

See application file for complete search history.

(56) References Cited

U.S. PATENT DOCUMENTS

| | | | | |
|---|---|---|---|---|
| 6,111,821 | A | 8/2000 | Bach | |
| 6,311,051 | B1 * | 10/2001 | Jung | H04L 25/063 375/319 |
| 2008/0075306 | A1 * | 3/2008 | Poulsen | H04R 19/005 381/111 |
| 2015/0146888 | A1 * | 5/2015 | Kim | H04R 19/005 381/114 |
| 2016/0014486 | A1 * | 1/2016 | Macours | H04R 1/02 381/111 |
| 2016/0282970 | A1 * | 9/2016 | Evreinov | G06F 3/03545 |
| 2016/0366499 | A1 * | 12/2016 | McGarry | H04R 1/023 |
| 2017/0033754 | A1 * | 2/2017 | Perrott | H03G 3/3026 |
| 2017/0264593 | A1 * | 9/2017 | Biswal | H04L 63/0428 |
| 2018/0091910 | A1 * | 3/2018 | Porter | H04R 29/001 |

FOREIGN PATENT DOCUMENTS

| | | |
|---|---|---|
| CN | 101753697 | 6/2010 |
| JP | 2008281578 | 11/2008 |
| JP | 2010109851 | 5/2010 |

* cited by examiner

*Primary Examiner* — Paul Kim
*Assistant Examiner* — Friedrich Fahnert
(74) *Attorney, Agent, or Firm* — The Farrell Law Firm, P.C.

(57) ABSTRACT

An electronic device is disclosed and includes a sensor module; an audio output module; and a processor configured to apply a preset DC offset to a sound signal provided to the audio output module based on a change in the internal pressure inside the electronic device, detected through the sensor module.

20 Claims, 10 Drawing Sheets

METHOD OF PROCESSING SOUND SIGNAL OF ELECTRONIC DEVICE AND ELECTRONIC DEVICE FOR SAME

PRIORITY

This application claims priority under 35 U.S.C. § 119(a) to Korean Patent Application Serial No. 10-2016-0169517, which was filed in the Korean Intellectual Property Office on Dec. 13, 2016, the entire content of which is incorporated herein by reference.

BACKGROUND

1. Field of the Disclosure

The present disclosure relates generally to a method of processing a sound signal with an electronic device and an electronic device for the same.

2. Description of the Related Art

Conventional electronic devices, such as smart phones and tablet PCs, can be designed to be waterproof. A waterproof electronic device may have an air vent hole formed therein, and a difference in internal pressure and external pressure of the electronic device due to outside applied pressure may be eliminated through the air vent hole. Accordingly, the air vent hole helps to prevent the electronic device from being damaged by inflation or compression. Alternatively, in order to minimize the inflation or compression, a waterproof electronic device may be designed such that a part to which outside pressure is applied, such as a battery cover or liquid crystal display, is strong enough to handle the difference between the internal pressure and the external pressure of the electronic device without being damaged.

When the rear surface of the electronic device is pressurized, a battery cover may be distorted (e.g., pressed), and, accordingly the electronic device may be subjected to an imbalance between internal pressure and external pressure. In order to eliminate the distortion of the battery cover, internal elements of the electronic device may be installed to have a minimum spacing therebetween. However, the battery cannot avoid distortion along a Z axis when being charged and/or discharged. Accordingly, when pressure is applied from the outside, the electronic device may be subjected to a difference between internal pressure and external pressure due to a gap inside the electronic device. Due to the difference between the internal pressure and the external pressure of the electronic device, a sensitive audio element (e.g., a speaker, a receiver, an audio output module, etc.) may not perform as designed or may be damaged. For example, when there is a gap due to discharging of the battery of the electronic device (e.g., when the battery is discharged to a level equal to or lower than 40%), an unusual or abnormal sound from the audio element may be generated if external pressure is applied to the electronic device.

Conventional electronic devices have solved the problem with audio elements through the design of an air vent hole or by compensating for the gap inside the electronic device caused by charging and/or discharging the battery. For example, the conventional electronic device has been designed to have an air vent hole formed inside a battery cover of the electronic device or that is exposed to the outside.

However, an electronic device designed to have the air vent hole exposed to the outside is not competitive in terms of design. The design that exposes the air vent hole to the outside in order to reduce the time required to balance internal pressure and external pressure of the electronic device does not match the current design trend which is toward a smooth and jointless design to outwardly conceal the hole in the electronic device. Further, the electronic device designed to have the air vent hole formed inside the battery cover has a disadvantage in that it cannot be applied to an all-in-one electronic device lacking a battery cover. In addition, when the route through which the air is discharged is lengthened due to a design in which the air vent hole is hidden from the outside, it may take a long time to balance the internal pressure with the external pressure of the electronic device. Moreover, enlarging the size of the air vent hole to enable the air inside the electronic device to be rapidly discharged imposes limitations on the design.

SUMMARY

Accordingly, an aspect of the present disclosure provides a method of processing a sound signal of an electronic device and the electronic device having an appealing design which can solve the problem with the audio element that occurs due to the difference between internal pressure and external pressure of the electronic device by rapidly resolving imbalance between the internal pressure and the external pressure of the electronic device according to the pressure applied from the outside.

According to another aspect of the present disclosure, the internal pressure and the external pressure of the electronic device can be balanced by controlling a start point, at which the diaphragm of the sound element of the electronic device vibrates, thereby preventing the audio element from generating an unusual sound due to the difference between the internal pressure and the external pressure of the electronic device.

In accordance with an aspect of the present disclosure, an electronic device is provided. The electronic device includes a sensor module; an audio output module; and a processor configured to apply a preset DC offset to a sound signal provided to the audio output module based on a change in an internal pressure of the electronic device detected through the sensor module. In accordance with another aspect of the present disclosure, a method of processing a sound signal by an electronic device is provided. The method includes detecting a change in an internal pressure of the electronic device through a sensor module of the electronic device; and applying a preset DC offset to a sound signal provided to an audio output module of the electronic device based on the detected change in the internal pressure.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
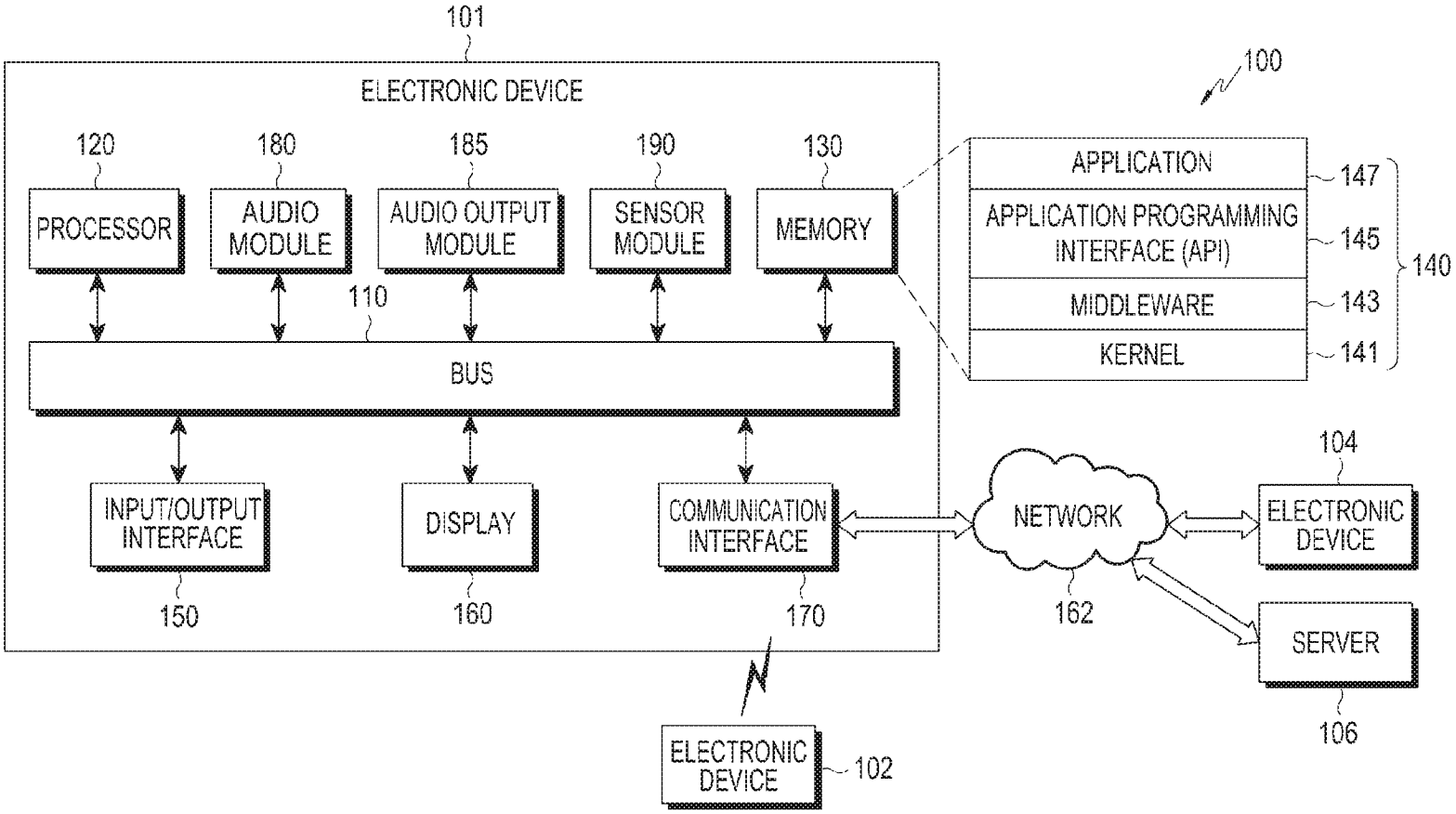
FIG. 1 illustrates a network environment including an electronic device according to various embodiments of the present disclosure.

The embodiments and the terms used therein are not intended to limit the technology disclosed herein to specific forms, and should be understood to include various modifications, equivalents, and/or alternatives to the corresponding embodiments. In describing the drawings, similar reference numerals may be used to designate similar elements. A singular expression may include a plural expression unless they are definitely different in the context. As used herein, singular forms may include plural forms as well unless the context clearly indicates otherwise.

The expressions "a first", "a second", "the first", or "the second" used in describing various embodiments of the present disclosure may modify various components regardless of the order and/or the importance, but do not limit the corresponding components. When an element (e.g., first element) is referred to as being "(functionally or communicatively) connected," or "directly coupled" to another element (e.g., second element), the element may be connected directly to another element or connected to another element through yet another element (e.g., third element). The term "and/or" covers a combination of a plurality of items, or any of the plurality of items.

The expression "configured to" as used in various embodiments of the present disclosure may be interchangeably used with, for example, "suitable for", "having the capacity to", "designed to", "adapted to", "made to", or "capable of" in terms of hardware or software, according to circumstances. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

An electronic device according to various embodiments of the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit). The electronic device may include at least one of, for example, a television, a digital versatile disk (DVD) player, an audio player, a refrigerator, an air conditioner, a vacuum cleaner, an oven, a microwave oven, a washing machine, an air cleaner, a set-top box, a home automation control panel, a security control panel, a TV box (e.g., Samsung HomeSync™ Apple TV™, or Google TV™), a game console (e.g., Xbox™ and PlayStation™), an electronic dictionary, an electronic key, a camcorder, and an electronic photo frame.

In various embodiments of the present disclosure, the electronic device may include at least one of various medical devices (e.g., portable medical measuring devices (e.g., a blood glucose monitoring device, a heart rate monitoring device, a blood pressure measuring device, a body temperature measuring device, etc.), a magnetic resonance angiography apparatus (MRA), a magnetic resonance imaging apparatus (MRI), a computed tomography (CT) machine, and an ultrasonic machine), a navigation device, a global positioning system (GPS) receiver, an event data recorder (EDR), a flight data recorder (FDR), a vehicle infotainment device, an electronic device for a ship (e.g., a navigation device for a ship, and a gyro-compass), avionics, security devices, an automotive head unit, a robot for home or industry, an automatic teller machine (ATM), a point of sales (POS) device, or Internet of things (IoT) device (e.g., a light bulb, various sensors, electric or gas meter, a sprinkler device, a fire alarm, a thermostat, a streetlamp, a toaster, a sporting goods, a hot water tank, a heater, a boiler, etc.).

An electronic device may include at least one of a part of furniture or a building/structure, an electronic board, an electronic signature receiving device, a projector, and various types of measuring instruments (e.g., a water meter, an electric meter, a gas meter, a radio wave meter, etc.). The electronic device may be flexible, or may be a combination of one or more of the aforementioned various devices. The electronic device is not limited to the above described devices. In the present disclosure, the term "user" may indicate a person using an electronic device or a device (e.g., an artificial intelligence electronic device) using an electronic device.

Figure 2A:
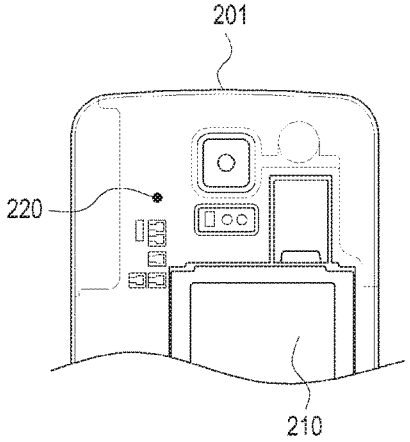
FIGS. 2A and 2B illustrate the structure of the electronic device which includes waterproofing.
Figure 2B:
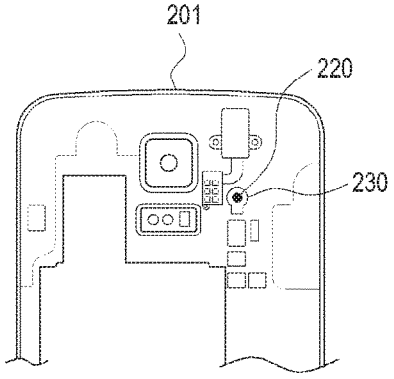

FIG. 1 illustrates a network environment including an electronic device according to various embodiments of the present disclosure. FIGS. 2A and 2B illustrate the structure of the electronic device including a waterproofing function.

An electronic device 101 in a network environment 100 according to various embodiments of the present disclosure may include a bus 110, a processor 120, a memory 130, an input/output interface 150, a display 160, a communication interface 170, an audio module 180, an audio output module 185, and a sensor module 190. The electronic device 101 may omit at least one of the elements, or may further include other elements.

The bus 110 may include, for example, a circuit that interconnects the elements 120 to 190, and transmits communication (e.g., control messages or data) between the elements.

The processor 120 may include one or more of a CPU, an AP, and a communication processor (CP). The processor 120, for example, may carry out operations or data processing relating to the control and/or communication of at least one other element of the electronic device 101.

The memory 130 may include volatile and/or non-volatile memory. The memory 130 may store, for example, instructions or data relevant to at least one other element of the electronic device 101. According to an embodiment of the present disclosure, the memory 130 may store software and/or a program 140. The program 140 may include, for example, a kernel 141, middleware 143, an application programming interface (API) 145, and/or applications 147. At least some of the kernel 141, the middleware 143, and the API 145 may be referred to as an operating system (OS).

The kernel 141 may control or manage system resources (e.g., the bus 110, the processor 120, or the memory 130) used for executing an operation or function implemented by other programs (e.g., the middleware 143, the API 145, or the applications 147). Furthermore, the kernel 141 may provide an interface through which the middleware 143, the API 145, or the applications 147 may access the individual elements of the electronic device 101 to control or manage the system resources.

The middleware 143 may function as, for example, an intermediary for allowing the API 145 or the applications 147 to communicate with the kernel 141 to exchange data. In addition, the middleware 143 may process one or more task requests received from the applications 147 according to priorities thereof. For example, the middleware 143 may assign priorities for using the system resources (e.g., the bus 110, the processor 120, the memory 130, etc.) of the electronic device 101 to one or more of the applications 147, and may process the one or more task requests.

The API 145 is an interface used by the applications 147 to control a function provided from the kernel 141 or the middleware 143, and may include, for example, at least one interface or function (e.g., an instruction) for file control, window control, image processing, character control, etc.

The input/output interface 150 may forward instructions or data, input from a user or an external device, to other element(s) of the electronic device 101, or may output instructions or data, received from the other element(s) of the electronic device 101, to the user or the external device.

The display 160 may include, for example, a liquid crystal display (LCD), a light-emitting diode (LED) display, an organic light-emitting diode (OLED) display, a micro electro mechanical system (MEMS) display, or an electronic paper display. The display 160 may display, for example, various types of content (e.g., text, images, videos, icons, and/or symbols) for a user. The display 160 may include a touch screen and may receive, for example, a touch, a gesture, a proximity or hovering input using an electronic pen or the user's body part.

The communication interface 170 may configure communication, for example, between the electronic device 101 and an external device (e.g., a first external electronic device 102, a second external electronic device 104, or a server 106). For example, the communication interface 170 may be connected to a network 162 through wireless or wired communication to communicate with the external device.

The wireless communication may include, for example, cellular communication that uses at least one of LTE, LTE-advanced (LTE-A), code division multiple access (CDMA), wideband CDMA (WCDMA), universal mobile telecommunications system (UMTS), wireless broadband (WiBro), global system for mobile communications (GSM), etc. According to an embodiment of the present disclosure, the wireless communication may include, for example, at least one of Wi-Fi, Bluetooth™, Bluetooth low energy (BLE), ZigBee, near field communication (NFC), magnetic secure transmission (MST), radio frequency (RF), and body area network (BAN). The wireless communication may include a global navigation satellite system (GNSS). The GNSS may be, for example, a GPS, a global navigation satellite system (GLONASS), a BeiDou navigation satellite system (BeiDou), or Galileo which is the European global satellite-based navigation system. Hereinafter, in this disclosure, the term "GPS" may be interchangeable with the term "GNSS". The wired communication may include, for example, at least one of a universal serial bus (USB), a high-definition multimedia interface (HDMI), recommended standard 232 (RS-232), a plain old telephone service (POTS), etc. The network 162 may include a telecommunications network, for example, at least one of a computer network (e.g., a LAN or a WAN), the Internet, and a telephone network.

The audio module 180 may include a codec and an amplifier (amp). The audio module 180 may convert sound into an electrical signal, and vice versa. The audio module 180 may process sound information output through the audio output module 185. The audio output module 185 may include at least one of a speaker and a receiver.

The sensor module 190 may include, for example, at least one of a pressure sensor and a displacement sensor, and may be used to determine whether there is a change in the internal pressure of the electronic device 101 (e.g., identify a difference between the internal pressure and the external pressure of the electronic device 101). The pressure sensor may be installed in the electronic device 101 and may measure the internal pressure of the electronic device 101. For example, the pressure sensor may be installed near an air vent hole or within the electronic device 101 to detect the pressure applied to the air vent hole. The displacement sensor (e.g., a piezo sensor) may be installed in a rear case, which is part of the housing of the electronic device 101, and may detect displacement of the rear case.

The rear case may be the rear case illustrated in FIG. 2A or 2B. The rear case may be the housing assembled on the rear surface of the electronic device 201 to support the display of the electronic device 201. FIG. 2A illustrates a first surface (e.g., rear surface) of the rear case, which contacts a battery cover when the battery cover is covered, and FIG. 2B illustrates a second surface (e.g., front surface) of the rear case. Referring to FIGS. 2A and 2B, a battery 210 for supplying power to an electronic device 201 may be located on the first surface of the rear case. Further, an air vent hole 220 may be formed which passes through the first surface and the second surface of the rear case, and a sealing member 230 (e.g., Gore-Tex™) for waterproofing, which allows air to pass therethrough, may be located over the air vent hole 220 in the second surface of the rear case. The air vent hole 220 may keep the internal pressure and the external pressure of the electronic device 201 the same as well as for waterproofing.

Further, the sensor module 190 may include, for example, at least one of a grip sensor, a gyro sensor, and a proximity sensor, and may be used to identify whether a user grips the electronic device 101 or the motion of the electronic device 101. The grip sensor may detect whether the electronic device 101 is being held. The gyro sensor may measure a bearing change of the electronic device 101. The proximity sensor may detect the presence of an object approaching the electronic device 101.

Each of the first and second external electronic devices 102 and 104 may be a device of a type that is the same as or different from that of the electronic device 101.

According to various embodiments of the present disclosure, all or some of the operations performed in the electronic device 101 may be performed in another electronic device or a plurality of electronic devices (e.g., the electronic devices 102 and 104, or the server 106). When the electronic device 101 has to perform a function or service automatically, or in response to a request, the electronic device 101 may request another device to perform at least some functions relating thereto additionally or instead of performing the function or service. Another electronic device may execute the requested functions or the additional functions, and may deliver the result of execution thereof to the electronic device 101. The electronic device 101 may provide the received result as it is, or may additionally process the received result in order to provide the requested functions or services. To this end, for example, cloud-computing technology, distributed-computing technology, or client-server-computing technology may be used.

According to various embodiments of the present disclosure, the electronic device 101 may include the sensor module 190, the audio output module 185, and the processor 120, or an audio module for applying a preset DC offset to a sound signal, which is provided to the audio output module, based on a change in the internal pressure of the electronic device detected through the sensor module.

According to various embodiments of the present disclosure, the processor may stop applying the DC offset to the sound signal provided to the audio output module when the internal pressure of the electronic device changes to a preset pressure.

According to various embodiments of the present disclosure, the audio output module may include a diaphragm that vibrates according to the sound signal and a device that detects the location of the diaphragm, and the location of a vibration start point of the diaphragm may change depending on the DC offset.

According to an embodiment of the present disclosure, the processor or the audio output module may detect the location of the diaphragm by providing an electrode to a grill and the diaphragm (or a metal plate attached to a particular point of the diaphragm (e.g., a center point thereof)) to measure a charge capacity to make the grill of the audio output module and the diaphragm of the audio output module serve as a capacitor. For example, when the + and − electrodes are provided to the grill and the diaphragm (or the metal plate described above), the grill and the diaphragm of the audio output module may serve as a capacitor, and the capacitor may be fully charged after a predetermined amount of time has passed. The processor or the audio output module may be configured to measure the charge capacity of the fully charged capacitor, and the processor or the audio output module may measure the charge capacity of the fully charged capacitor. When the interval between the diaphragm of the audio output module and the grill of the audio output module changes due to a change in the location of the diaphragm of the audio output module, the charge capacity also changes. Accordingly, the processor or the audio output module may detect the location of the diaphragm of the audio output module based on the change in the charge capacity. For example, the electronic device may pre-store the charge capacity for each location of the diaphragm or location interval, and the processor or the audio output module may detect the location of the diaphragm of the audio output module by measuring the charge capacity. The sensor module may include a pressure sensor located within the electronic device to measure the internal pressure of the electronic device, and the processor or the audio output module may apply the DC offset to the sound signal provided to the audio output module when the internal pressure of the electronic device, measured using a pressure sensor, falls outside of a preset reference pressure range.

According to various embodiments of the present disclosure, the electronic device may further include a housing including a front case, to which a display panel of the electronic device is attached, and a rear case disposed on a rear surface of the electronic device, wherein the sensor module may include a displacement sensor attached to the rear case to measure the displacement of the rear case, and the processor may apply the DC offset to the sound signal provided to the audio output module when the displacement measured through the displacement sensor falls outside of a preset reference change range.

According to various embodiments of the present disclosure, the electronic device may detect the location of the diaphragm of the speaker or the receiver of the audio output module before reproducing the sound signal, and when the location of the diaphragm is above or below the original location, apply the DC offset to the sound signal provided to the audio output module.

According to various embodiments of the present disclosure, the processor may detect the change in the internal pressure of the electronic device when the audio output module is executed.

According to various embodiments of the present disclosure, the electronic device may further include a battery, and the processor may detect the change in the internal pressure of the electronic device when a state of charge of a battery of the electronic device is lower than a preset reference state of charge.

According to various embodiments of the present disclosure, the sensor module may include a grip sensor, and the processor may detect a change in the internal pressure of the electronic device when a grip of the electronic device is detected through the grip sensor.

According to various embodiments of the present disclosure, the sensor module may include at least one of a gyro sensor and a proximity sensor, and the processor may detect the change in the internal pressure of the electronic device when a bearing change of the electronic device is detected through the gyro sensor or when the presence of an object is detected through the proximity sensor.

According to various embodiments of the present disclosure, the electronic device may further include an input/output interface 150 and a communication interface 170, wherein the processor may detect the change in the internal pressure of the electronic device when user input is received through the input/output interface to execute a call using the communication interface.

According to various embodiments of the present disclosure, the electronic device may include an input/output interface 150, wherein the processor may detect the change in the internal pressure of the electronic device when user input for reproducing a media file is received through the input/output interface.

According to various embodiments of the present disclosure, the processor may detect the change in the internal pressure of the electronic device through the sensor module by identifying the location of a diaphragm of the audio output module right before the sound signal is output from the audio output module.

Figure 3B:
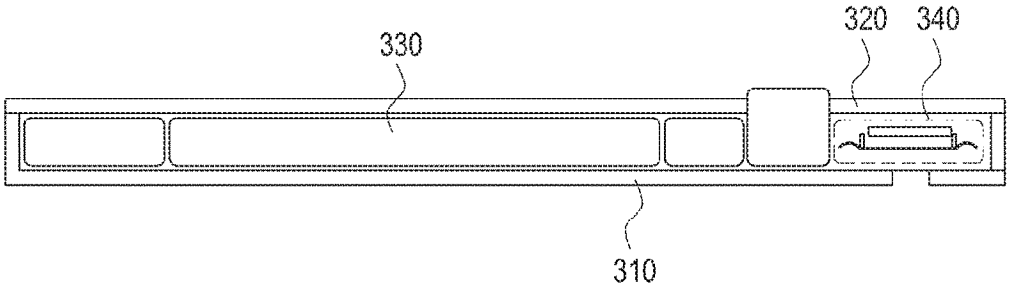
FIGS. 3A to 3C illustrate the configuration of the electronic device according to various embodiments of the present disclosure.
Figure 3C:
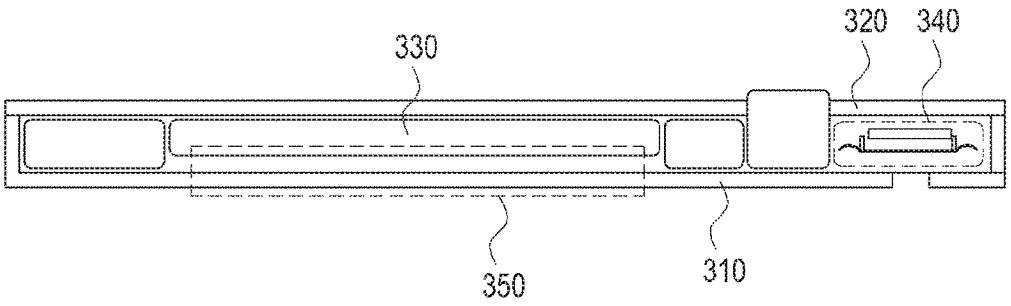
Figure 3A:
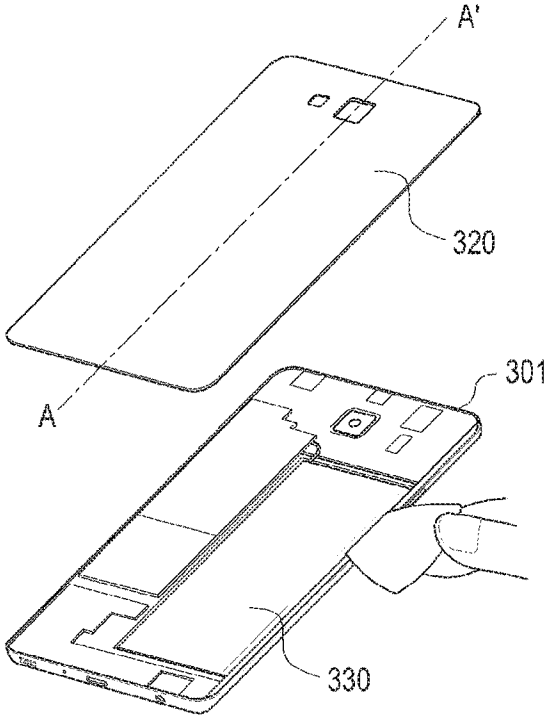

FIGS. 3A to 3C illustrate the configuration of an electronic device according to various embodiments of the present disclosure.

In general, a battery 330 of an electronic device 301 has a characteristic in that distortion along a Z axis occurs when charging and/or discharging is performed. For example, the battery 330 may have an expansion characteristic when being charged, and have a contraction characteristic when being discharged. The battery 330 may be attached/detached as illustrated in FIG. 3A. The battery 330 may be built into the electronic device 301.

Depending on the characteristics of the battery 330, there may be a gap within the electronic device 301 depending on the state of charge of the battery 330.

The cross-sectional view taken along the line A-A' of the electronic device 301 with the rear cover 320 may have the form illustrated in FIG. 3B or 3C. Referring to FIGS. 3B and 3C, the electronic device 301 may include a front cover 310, which may also be referred to as a display panel, and a rear cover 320, which may also be referred to as a battery cover, and an audio output module 340 and a battery 330 may be located at the inner side of the front cover 310 and the rear cover 320.

When the battery 330 of the electronic device 301 is completely charged, there may be little or no gap between the battery 330 and the front cover 310, as illustrated in FIG. 3B. Meanwhile, when the battery 330 of the electronic device 301 has the charge reduced, a gap 350 between the battery 330 and the front cover 310 may form or expand as illustrated in FIG. 3C.

When the gap 350 between the battery 330 and the front cover 310 is generated as illustrated in FIG. 3C and pressure is applied in an inward direction of the front cover 310 and the rear cover 320 (hereinafter, referred to as a set of the electronic device 301 including both the front cover 310 and the rear cover 320), the set of the electronic device 301 may be subjected to a difference between internal pressure and external pressure due to the gap 350, and the audio output module 340 may output an unusual sound. The audio output module 340 may be, for example, a speaker or a receiver.

An unusual sound of a receiver 440 created by the difference between the internal pressure and the external pressure of the set of the electronic device will be described with reference to FIGS. 4A to 4C.

Figure 4A:
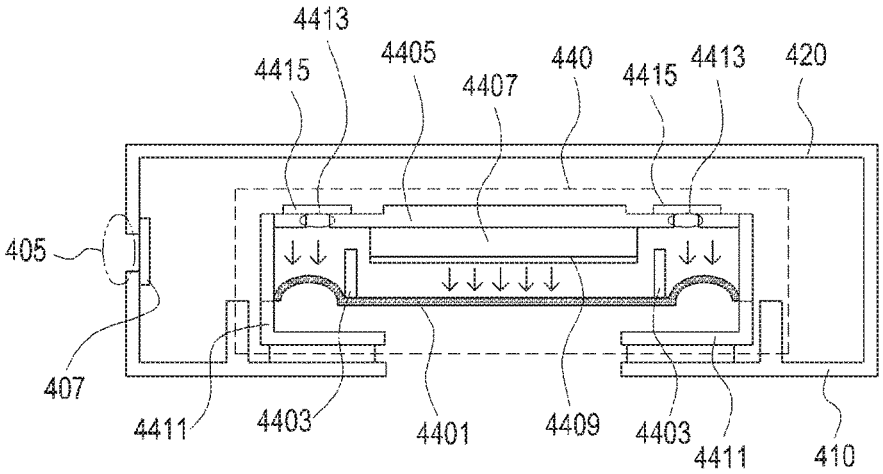
FIGS. 4A to 4C illustrate the generation of an unusual sound of a receiver due to external pressure according to various embodiments of the present disclosure.
Figure 4B:
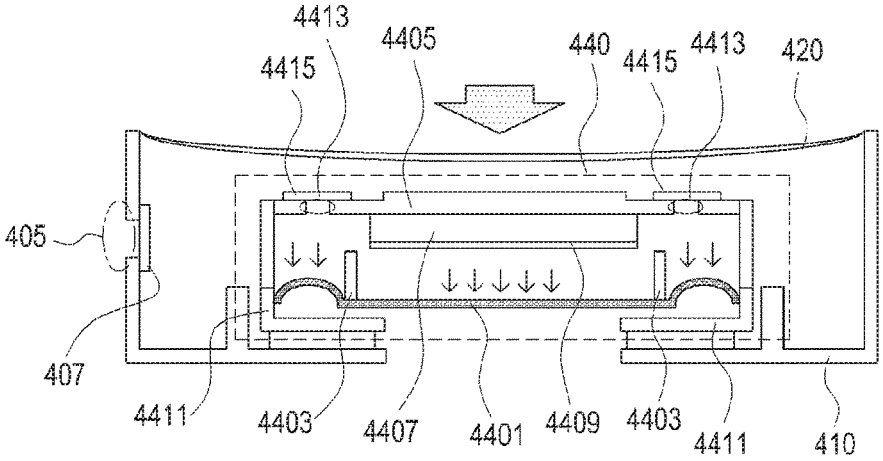
Figure 4C:
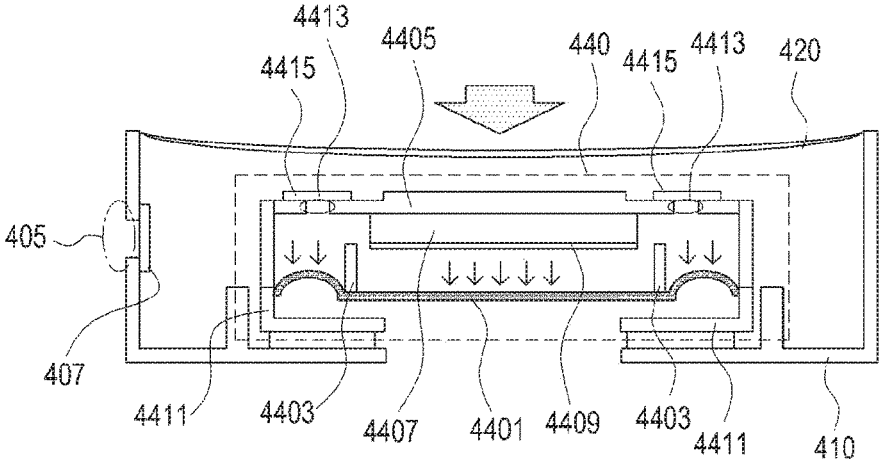

FIGS. 4A to 4C illustrate the generation of an unusual sound of a receiver due to external pressure according to various embodiments of the present disclosure.

Referring to FIGS. 4A to 4C, the receiver 440 may be located inside a front cover 410 and a rear cover 420, and the front cover 410 and the rear cover 420 may be connected to at least one air vent hole 405 to allow air to flow in the front cover 410 and the rear cover 420. A sealing member 407 may be attached to the air vent hole 405.

Referring to FIGS. 4A to 4C, the receiver 440 may include a diaphragm 4401, a coil 4403, a yoke 4405, a magnet 4407, a plate 4409, and a frame 4411. The yoke 4405 may have one or more holes 4413 formed therein, and the hole 4413 may have a member 4415 formed thereon for controlling the resistance of the hole 4413.

As illustrated in FIGS. 4A to 4C, the receiver 440 may be disposed such that the yoke 4405 included in the receiver 440 is located toward the rear cover 420.

FIG. 4A illustrates an example in which the receiver 440 operates normally as the internal pressure (P0) inside the front cover 410 and the rear cover 420 (hereinafter, referred to as a set of the electronic device including both the front cover 410 and the rear cover 420), and the external pressure outside the set of the electronic device are the same as each other.

As illustrated in FIG. 4B, when inward pressure is applied to the set of the electronic device, the set of the electronic device may be distorted (e.g., compressed). When pressure is applied to the inside of the set of the electronic device from the outside of the rear cover 420, the internal volume (V0) of the set of the electronic device may be reduced suddenly, and, accordingly, the internal pressure of the set of the electronic device may increase and the diaphragm 4401 of the receiver 440 may vibrate abnormally. For example, since the diaphragm 4401 of the receiver 440 moves in the direction in which outside force is applied, the diaphragm 4401 may strike the frame 4411 during vibration, and, accordingly, the receiver 440 may generate an unusual sound.

After a predetermined time (t0) has passed since the inward pressure was applied to the set of the electronic device, the internal pressure and the external pressure of the set of the electronic device may return to the equilibrium state (e.g., atmospheric pressure). For example, with the passage of time, the internal pressure in the set of the electronic device may change to the same level as that of the external pressure outside the set of the electronic device as the air inside the set of the electronic device is discharged through the air vent hole 405 as illustrated in FIG. 4C, and, finally, the internal pressure and the external pressure of the set of the electronic device may be in an equilibrium state.

As described above, the set of the electronic device may have pressure imbalance between the inside and the outside thereof due to the change in the state of charge of the battery of the electronic device and/or the inward pressure applied to the electronic device. When a sound is output, the audio output module may have an unusual sound due to the pressure imbalance between the inside and the outside of the set of the electronic device. In order to solve the problem, the operation of the electronic device for preventing the unusual sound from being output through the audio output module will be described with reference to FIGS. 5 to 8.

Figure 5:
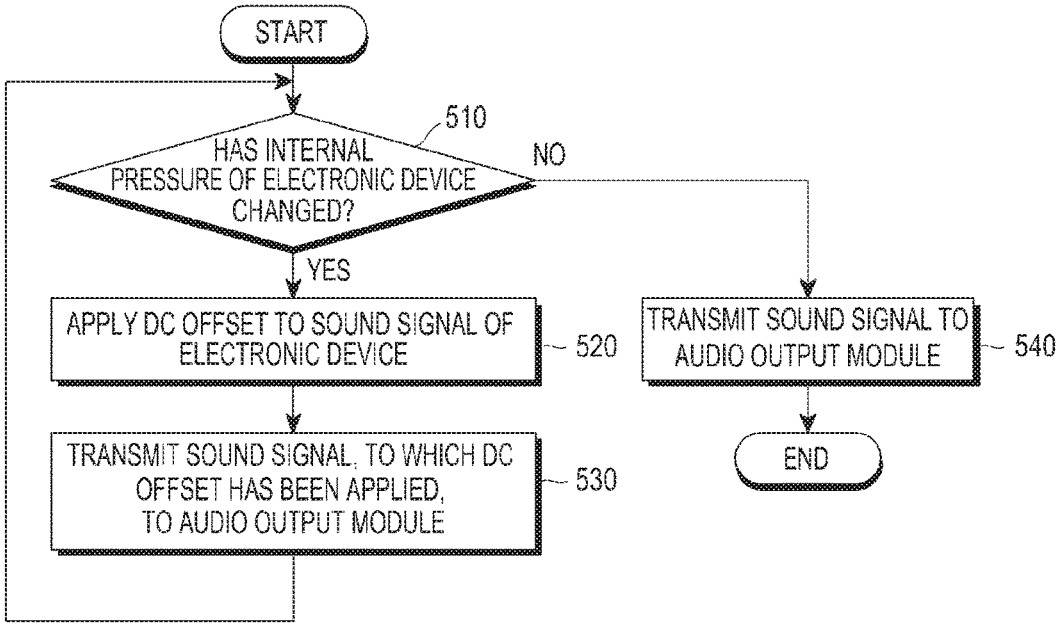
FIG. 5 is a flowchart illustrating a sound-signal-processing operation of the electronic device according to various embodiments of the present disclosure.
Figure 6A:
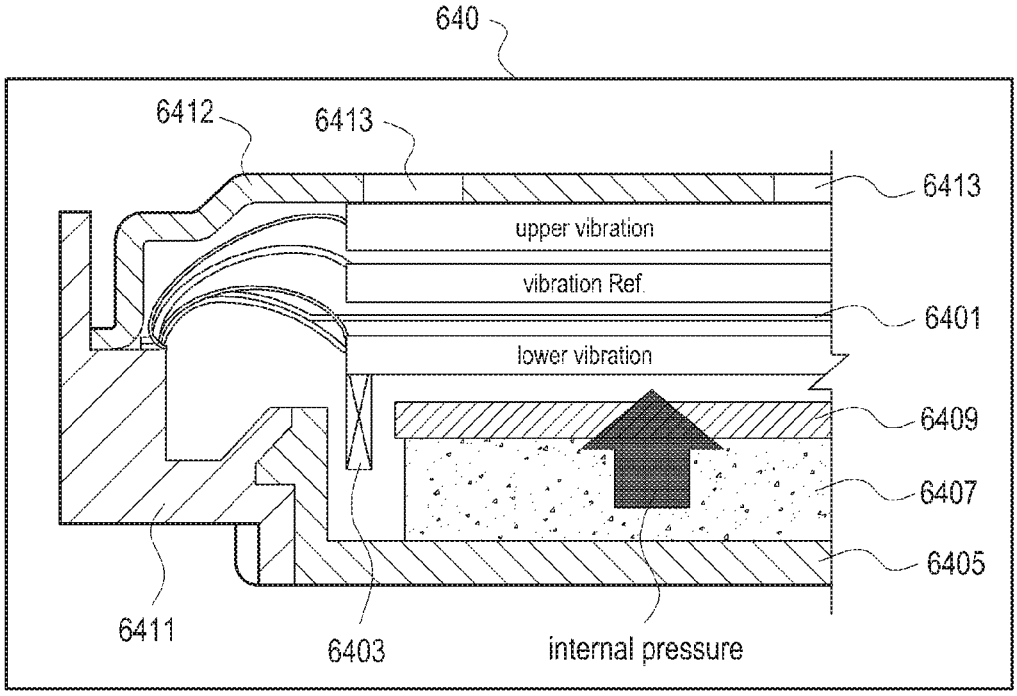
FIGS. 6A and 6B illustrate the operation of a speaker based on a sound signal according to various embodiments of the present disclosure.
Figure 6B:
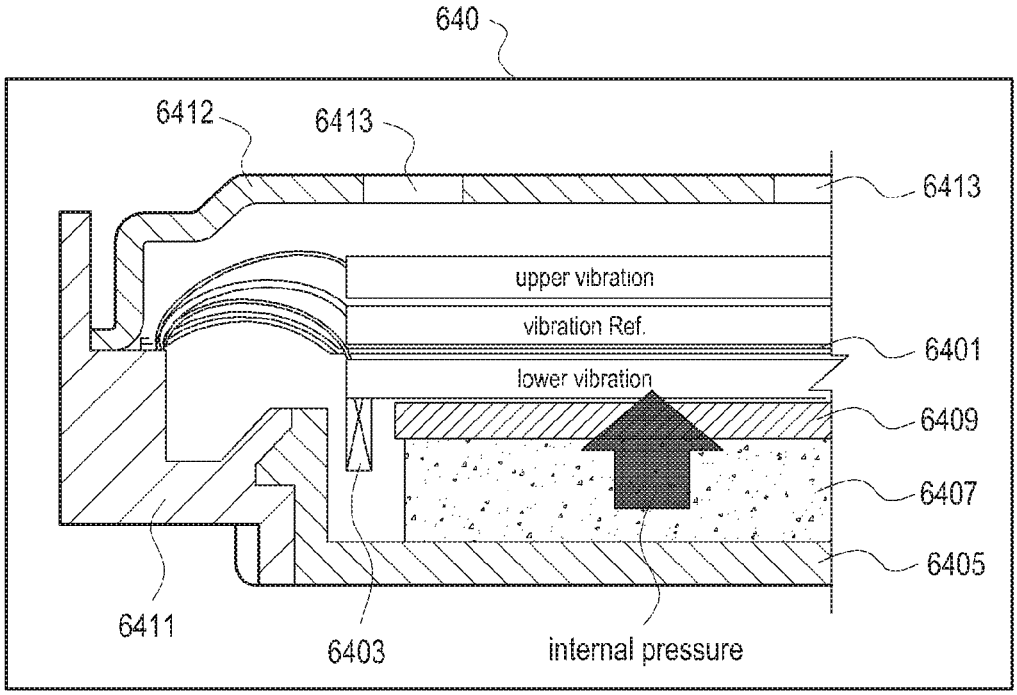

FIG. 5 is a flowchart illustrating a sound-signal-processing operation of an electronic device according to various embodiments of the present disclosure. FIGS. 6A and 6B illustrate the operation of a speaker based on a sound signal according to various embodiments of the present disclosure.

Referring to FIG. 5, when the internal pressure inside the electronic device exceeds an allowable pressure range based on a change in the internal pressure of the electronic device, the electronic device may output a sound signal after applying a preset DC offset to the sound signal to be transmitted to the audio output module until the internal pressure in the electronic device becomes the same as external pressure with the air flowing inside the electronic device through the air vent hole in the electronic device. By outputting the sound signal after applying the DC offset to the sound signal, the electronic device may control a starting point (e.g., reference point) at which the diaphragm of the audio output module vibrates, and, accordingly, may prevent an outputting of an unusual sound from occurring due to an imbalance between the internal pressure and external pressure of the electronic device.

In operation 510, the electronic device determines whether the internal pressure of the electronic device changes.

For example, the electronic device may measure the internal pressure of the electronic device through a pressure sensor attached to the inside of the electronic device. When the internal pressure measured through the pressure sensor falls outside of a preset reference pressure range, the electronic device may determine that the internal pressure of the electronic device changes (e.g., increases) and/or that the electronic device is pressurized.

In another example, displacement of the rear case may be measured through a displacement sensor attached to the rear case of the electronic device. When the displacement measured through the displacement sensor falls outside of a preset reference displacement range, the electronic device may determine that the internal pressure of the electronic device has changed (e.g., increased) and/or that the electronic device is pressurized.

In another example, when the electronic device detects the location of the diaphragm of the speaker or the receiver of the audio output module and the location of the diaphragm is above or below the original location, the electronic device may determine that the internal pressure changes (e.g., increases) and/or that the electronic device is pressurized.

When the electronic device determines that the internal pressure of the electronic device changes in operation 510, the electronic device proceeds to operation 520, or when the internal pressure has not changed, the electronic device proceeds to operation 540.

Referring to FIGS. 6A and 6B, it may be noted that a vibration starting point of the diaphragm of the audio output module of the electronic device changes as the internal pressure of the electronic device is increased.

FIG. 6A is a cross-sectional view of a speaker 640 of the electronic device when the internal pressure of the electronic device changes (e.g., increases). The speaker 640 may include a diaphragm 6401, a coil 6403, a yoke 6405, a magnet 6407, a plate 6409, a frame 6411, and a grill 6412. The grill 6412 may have two holes 6413 formed therein which allow sound to be output to the outside of the electronic device. The speaker 640 may be disposed such that a yoke plate 6405 included in the speaker 640 is located toward the rear cover.

When inward pressure is applied to the electronic device, inward pressure is applied to the speaker 640, and, accordingly, the internal pressure of the speaker 640 may increase and the diaphragm 6401 of the speaker 640 may move in the direction in which the pressure is applied (e.g., toward the grill 6412) as illustrated in FIG. 6A. In such a situation, when the diaphragm 6401 of the speaker 640 vibrates to output a sound, the diaphragm 6401 may hit the grill 6412, and, accordingly, the speaker 640 may generate an unusual sound.

Figure 7:
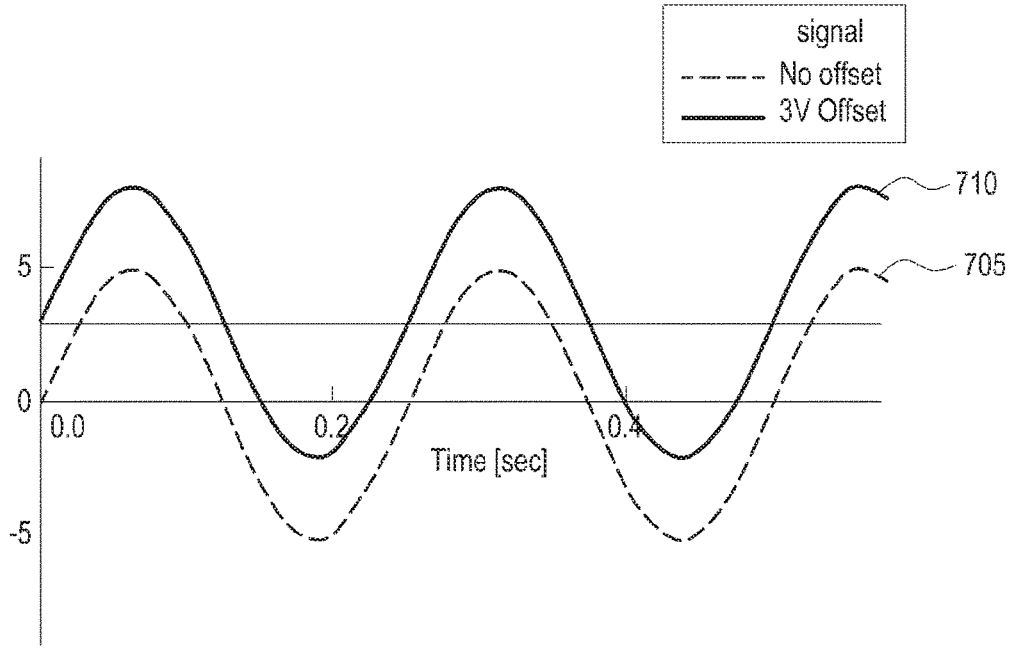
FIG. 7 is a graph illustrating sound signals transmitted to a speaker according to various embodiments of the present disclosure.

FIG. 7 is a graph illustrating sound signals transmitted to a speaker according to various embodiments of the present disclosure.

Referring to FIG. 7, a sound signal 705 may form a sine wave centered on 0 V, and thus the vibration start point of the diaphragm of the audio output module may correspond to 0 V.

Referring back to FIG. 5, in operation 520, the electronic device applies a preset DC offset to a sound signal to be transmitted to the audio output device. For example, the DC offset may be preset for each internal pressure and stored. The DC offset may be applied to a sound signal output from the codec or the amplifier of the electronic device.

In operation 530, the electronic device transmits the sound signal, to which the DC offset has been applied, to the audio output module.

Referring to FIG. 6B, the diaphragm 6401 of the speaker 640, having received the sound signal to which the DC offset has been applied, may move in accordance with the DC offset, and the diaphragm 6401 may vibrate without hitting the grill 6412 or the plate 6409.

Referring again to FIG. 7, a sound signal 710, to which a DC offset (e.g., 3 V) has been applied, may form a sine wave centered on the voltage value of the DC offset, and accordingly, a vibration start point of the diaphragm of the audio output module may change corresponding to the DC offset. Accordingly, the above-described unusual sound of the audio output module may be prevented.

In operation 540, the electronic device transmits a sound signal, to which the DC offset has not been applied, to the audio output module.

According to an embodiment of the present disclosure, after operation 530, the electronic device may continuously check for a change in internal pressure of the electronic device by repeatedly performing operation 510. For example, since the air inside the electronic device may be discharged to the outside through the air vent hole or the air outside the electronic device may flow in through the air vent hole until the internal pressure of the electronic device becomes the same as the external pressure of the electronic device, the internal pressure of the electronic device may change over time. Accordingly, the electronic device may transmit the sound signal to the audio output module after applying the DC offset to the sound signal until the internal pressure of the electronic device becomes the same as the external pressure or until the internal pressure of the electronic device falls within the allowable internal pressure range, so that the audio output module may output the sound without causing an unusual sound.

According to an embodiment of the present disclosure, when a predetermined time has passed since operation 540, operation 510 may be repeatedly performed.

According to an embodiment of the present disclosure, when output of the audio output module is needed in the state of imbalance between the internal pressure and the external pressure of the electronic device (e.g., during a phone call or when playing back music), the electronic device may apply the DC offset to the sound signal to the audio output module for a predetermined time and the audio output module may output a sound corresponding to the sound signal, to which the DC offset has been applied, and the application of the DC offset may end when the internal pressure and the external pressure of the electronic device becomes about the same as each other.

According to an embodiment of the present disclosure, when a phone call is made, the electronic device may determine whether the internal pressure of the electronic device changes in operation 510. For example, when a call using a communication interface 170 is made, the electronic device may perform operation 510. In another example, when a user input is received through the input/output interface 150 to perform the call using the communication interface 170, operation 510 may be performed.

According to an embodiment of the present disclosure, when a grip of the electronic device is detected through the grip sensor, the electronic device may perform operation 510. For example, when the user of the electronic device grips the electronic device to make a call, the grip sensor of the electronic device may detect the grip, and operation 510 may be performed.

According to an embodiment of the present disclosure, when the electronic device detects a bearing change of the electronic device through the gyro sensor and/or the presence of an object through the proximity sensor, operation 510 may be performed. For example, when the user of the electronic device picks up the electronic device to make a call, this may be detected by the gyro sensor of the electronic device. When the user moves the electronic device close to his/her face to make a call, the proximity sensor of the electronic device may detect this, and operation 510 may be performed.

According to an embodiment of the present disclosure, when a state of charge of the battery of the electronic device is lower than a reference state of charge during a phone call, the electronic device may perform operation 510.

According to an embodiment of the present disclosure, when a media file is reproduced, the electronic device may perform operation 510. For example, when user input for reproducing the media file is received through an input/output 150, the electronic device may perform operation 510.

According to an embodiment of the present disclosure, the electronic device may detect the location of the diaphragm of the speaker of the receiver of the audio output module before reproducing a sound signal, and may perform operation 510. For example, when the location of the diaphragm is above or below the original location, the electronic device may perform operation 510.

According to an embodiment of the present disclosure, when the state of charge of the battery of the electronic device falls below the reference state of charge during the reproduction of the media file, the electronic device may perform operation 510.

It will be understood by those skilled in the art that the circumstances described above for triggering the performance of operation 510 are mere examples, and the present disclosure is not limited thereto.

Figure 8:
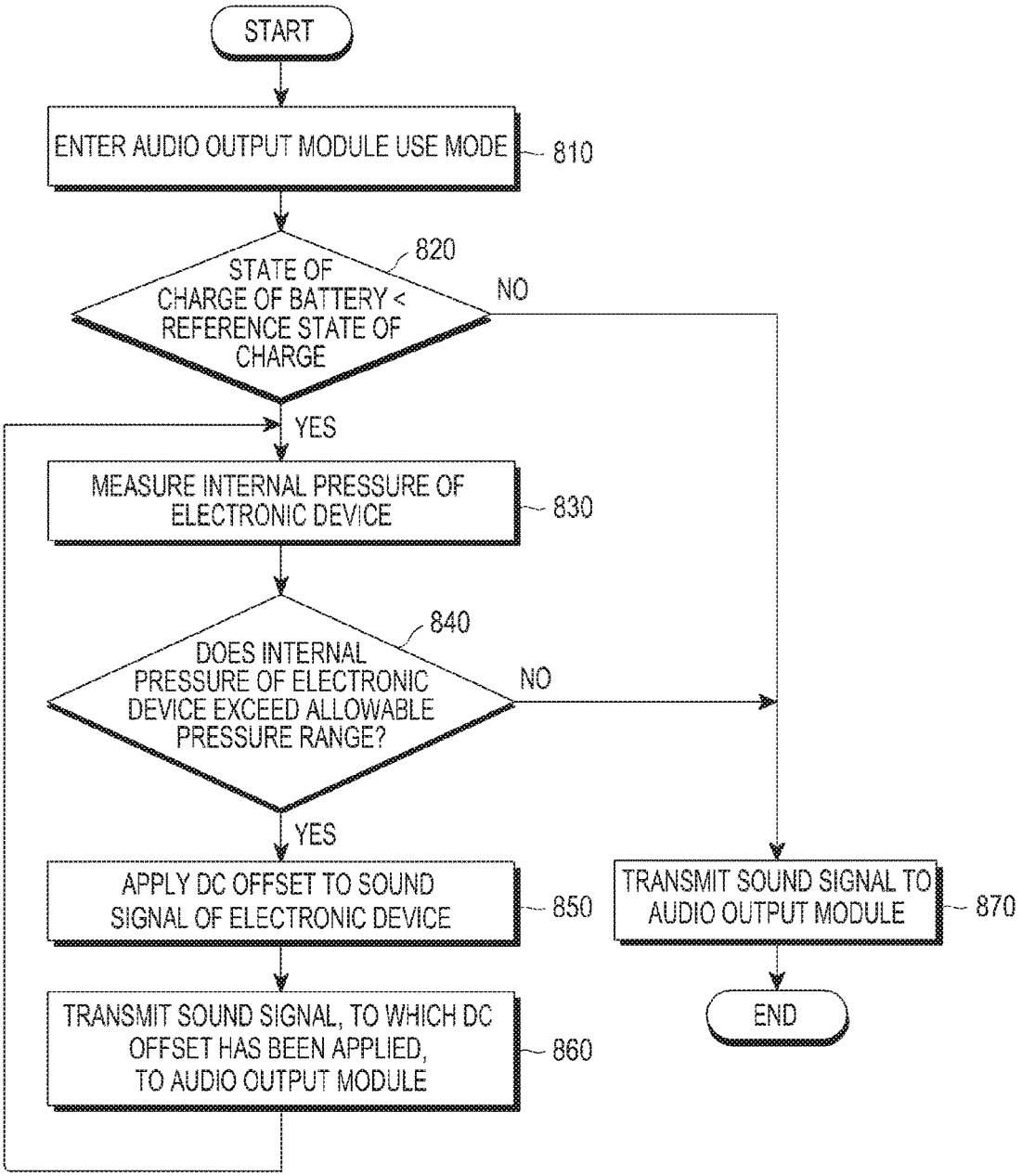
FIG. 8 is a flowchart illustrating a sound-signal-processing operation of the electronic device according to various embodiments of the present disclosure.

FIG. 8 is a flowchart illustrating a sound-signal-processing operation of an electronic device according to various embodiments of the present disclosure. Referring to FIG. 8, when the electronic device detects that the internal pressure of the electronic device exceeds an allowable range (e.g., reference pressure range), the electronic device may transmit a sound signal to the audio output module after applying a DC offset to the sound signal until the internal pressure of the electronic device is balanced with the external pressure. By applying the DC offset to the sound signal, the electronic device may control the starting point at which the diaphragm of the audio output module vibrates, and, accordingly, may help prevent an unusual sound generated due to imbalance between the internal pressure and the external pressure of the electronic device when the electronic device outputs the sound.

In operation 810, the electronic device may enter an audio output module use mode. The audio output module may be, for example, a speaker or a receiver. The entry into the audio output module use mode may include various modes, for example, modes in which media files such as an MP3 file and a video are reproduced, and a phone call is made.

In operation 820, the electronic device determines whether a state of charge of the battery of the electronic device is less than a preset reference state of charge.

When the electronic device determines that the state of charge of the battery of the electronic device is lower than the reference state of charge, the electronic device performs operation 830, or when the state of charge is greater than or equal to the reference state of charge, the electronic device performs operation 870.

In operation 830, the electronic device measures the internal pressure of the electronic device. For example, the electronic device may measure the internal pressure of the electronic device through a pressure sensor.

In operation 840, the electronic device determines whether the internal pressure of the electronic device exceeds a preset allowable pressure range.

When the electronic device determines that the internal pressure of the electronic device exceeds the preset allowable pressure range in operation 840, the electronic device performs operation 850, or when internal pressure of the electronic device is less than or equal to the preset allowable pressure range in operation 840, the electronic device performs operation 870.

In operation 850, the electronic device applies a preset DC offset to a sound signal to be transmitted to the audio output device. For example, the DC offset may be preset for each internal pressure and stored.

In operation 860, the electronic device transmits the sound signal, to which the DC offset has been applied, to the audio output module.

In operation 870, the electronic device transmits a sound signal, to which the DC offset has not been applied, to the audio output module.

According to an embodiment of the present disclosure, after operation 860, the electronic device may continuously check for a change in the internal pressure of the electronic device by repeatedly performing operation 830. For example, since the air inside the electronic device may be discharged to the outside through the air vent hole or since the external air of the electronic device may flow in through the air vent hole until the internal pressure of the electronic device becomes about the same as the external pressure of the electronic device, the internal pressure of the electronic device may change over time. Accordingly, the electronic device may transmit the sound signal to the audio output module after applying the DC offset to the sound signal until the internal pressure of the electronic device becomes about the same as the external pressure or until the internal pressure of the electronic device enters the allowable internal pressure range, so that the audio output module may output the sound without the unusual sound.

According to an embodiment of the present disclosure, when a predetermined time has passed after operation 860, the electronic device may repeatedly perform operation 830.

According to various embodiments of the present disclosure, a method of processing a sound signal by an electronic device may include an operation of detecting a change in the internal pressure of the electronic device through a sensor module of the electronic device or the location of a diaphragm of an audio output module; and an operation of applying a preset DC offset to a sound signal provided to the audio output module of the electronic device based on the detected change in the internal pressure.

According to various embodiments of the present disclosure, the method of processing the sound signal by the electronic device may further include an operation of stopping application of the DC offset to the sound signal provided to the audio output module when the internal pressure of the electronic device changes to a preset pressure value.

According to various embodiments of the present disclosure, the audio output module may include a diaphragm that vibrates according to the sound signal, and the location of a vibration starting point of the diaphragm may change depending on the DC offset.

According to various embodiments of the present disclosure, the sensor module may include a pressure sensor located within the electronic device to measure the internal pressure of the electronic device, and the operation of detecting the change in the internal pressure of the electronic device may include an operation of measuring the internal pressure of the electronic device through the pressure sensor; an operation of, when the measured internal pressure falls outside of a preset reference pressure range, determining that the internal pressure of the electronic device has changed; and an operation of, when it is determined that the internal pressure of the electronic device has changed, applying the DC offset to the sound signal provided to the audio output module.

According to various embodiments of the present disclosure, the electronic device may include a housing including a front case, to which a display panel of the electronic device is attached, and a rear case disposed on the rear surface of the electronic device, the sensor module may include a displacement sensor attached to the rear case to measure the displacement of the rear case, and the operation of detecting the change in the internal pressure of the electronic device may include an operation of measuring displacement of the rear case through the displacement sensor; an operation of, when the measured internal displacement falls outside of a preset reference pressure range, an operation of determining that the internal pressure of the electronic device changes; and an operation of, when it is determined that the internal pressure of the electronic device changes, applying the DC offset to the sound signal provided to the audio output module.

According to various embodiments of the present disclosure, the method may further include an operation of detecting the change in the internal pressure of the electronic device when the audio output module is executed.

According to various embodiments of the present disclosure, the method may further include an operation of detecting the change in the internal pressure of the electronic device when the state of charge of a battery of the electronic device is lower than a preset reference state of charge.

According to various embodiments of the present disclosure, the sensor module may include a grip sensor, and the method may further including an operation of detecting a change in the internal pressure of the electronic device when it is detected through the grip sensor that the electronic device is being gripped.

According to various embodiments of the present disclosure, the sensor module may include at least one of a gyro sensor and a proximity sensor, and the method further including detecting the change in the internal pressure of the electronic device when a bearing change of the electronic device is detected through the gyro sensor or when the presence of an object is detected through the proximity sensor.

According to various embodiments of the present disclosure, the method may further include an operation of detecting the location of the diaphragm of the speaker or the receiver of the audio output module before reproducing the sound signal, comparing the current location of the diaphragm with the original location, and detecting a change in the internal pressure.

Figure 9:
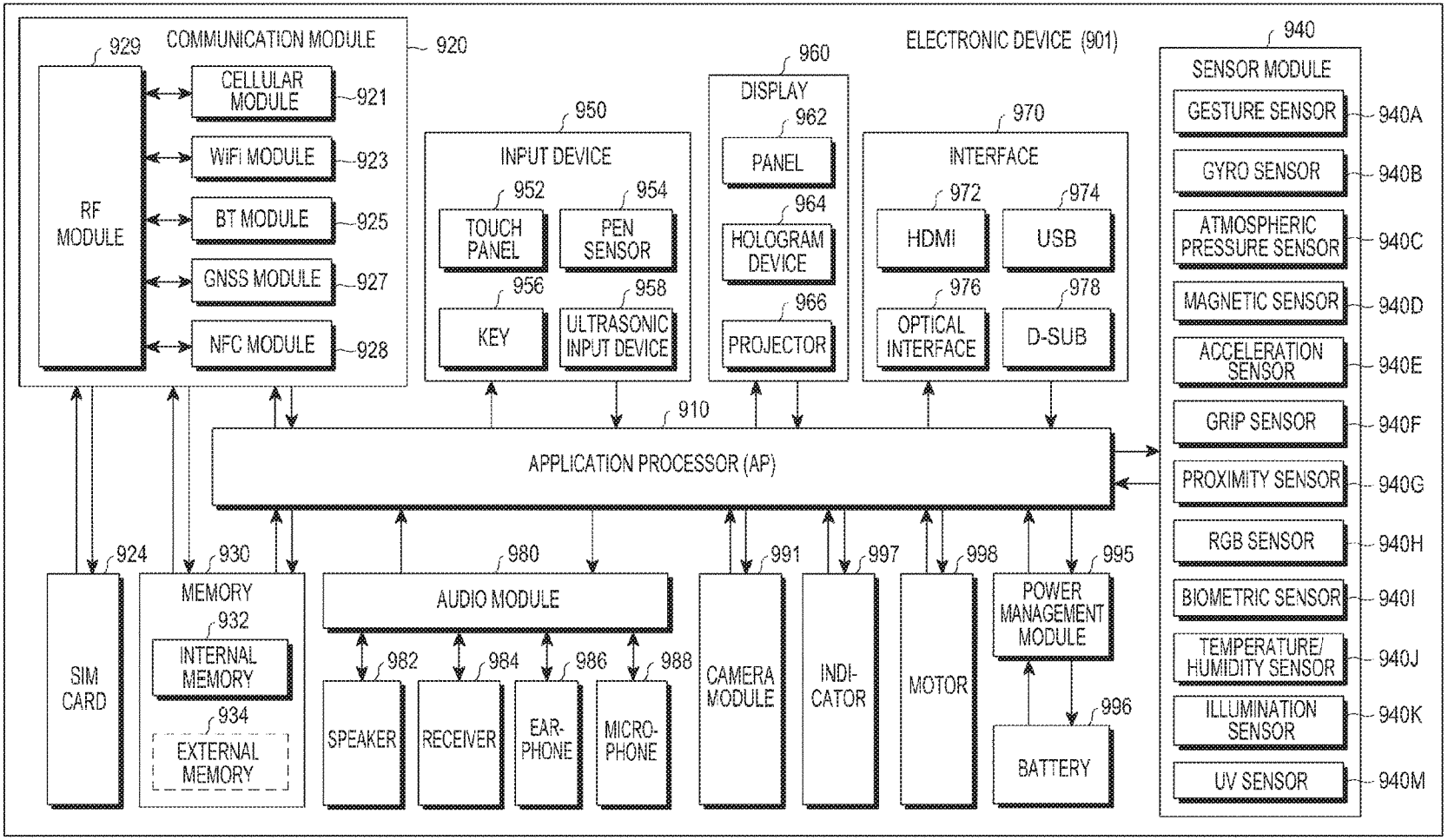
FIG. 9 is a block diagram illustrating the electronic device according to various embodiments of the present disclosure.

FIG. 9 is a block diagram illustrating an electronic device 901 according to various embodiments of the present disclosure. The electronic device 901 may include, for example, all or part of the electronic device 101. The electronic device 901 may include at least one processor 910 (e.g., an AP), a communication module 920, a subscriber identification module (SIM) 924, a memory 930, a sensor module 940, an input device 950, a display 960, an interface 970, an audio module 980, a camera module 991, a power management module 995, a battery 996, an indicator 997, and a motor 998. The processor 910 may control a plurality of hardware or software elements connected thereto and may perform various data processing and operations by driving an OS or an application program. The processor 910 may be implemented by, for example, a system on chip (SoC). The processor 910 may further include a graphic processing unit (GPU) and/or an image signal processor (ISP). The processor 910 may also include at least some of the elements of electronic device 901 (e.g., a cellular module 921). The processor 910 may load, in volatile memory, instructions or data received from at least one of the other elements (e.g., non-volatile memory), process the loaded instructions or data, and store the resultant data in the non-volatile memory.

The communication module 920 may have a configuration that is the same as, or similar to, that of the communication interface 170. The communication module 920 may include, for example, a cellular module 921, a Wi-Fi module 923, a Bluetooth™ (BT) module 925, a GNSS module 927, an NFC module 928, and an RF module 929. The cellular module 921 may provide, for example, a voice call, a video call, a text message service, an Internet service, etc. through a communication network. According to an embodiment of the present disclosure, the cellular module 921 may identify or authenticate an electronic device 901 in the communication network using a SIM 924. The cellular module 921 may perform at least some of the functions that the processor 910 may provide. The cellular module 921 may include a CP. At least some (e.g., two or more) of the cellular module 921, the Wi-Fi module 923, the BT module 925, the GNSS module 927, and the NFC module 928 may be included in a single integrated circuit (IC) or an IC package. The RF module 929 may transmit/receive, for example, a communication signal (e.g., an RF signal). The RF module 929 may include, for example, a transceiver, a power amp module (PAM), a frequency filter, a low-noise amplifier (LNA), an antenna, etc. At least one of the cellular module 921, the Wi-Fi module 923, the BT module 925, the GNSS module 927, and the NFC module 928 may transmit/receive an RF signal through a separate RF module. The SIM 924 may include, for example, a card that includes a SIM, or an embedded SIM, and may contain unique identification information (e.g., an integrated circuit card identifier (ICCID)) or subscriber information (e.g., an international mobile subscriber identity (IMSI)).

The memory 930 may include, for example, an internal memory 932 or an external memory 934. The internal memory 932 may include, for example, at least one of a volatile memory (e.g., a DRAM, an SRAM, an SDRAM, etc.) and a non-volatile memory (e.g., a one-time-programmable ROM (OTPROM), a PROM, an EPROM, an EEPROM, a mask ROM, a flash ROM, a flash memory, a hard disk drive, or a solid-state drive (SSD)). The external memory 934 may include a flash drive, for example, a compact flash (CF), a secure digital (SD), a Micro-SD, a Mini-SD, an eXtreme digital (xD), a multi-media card (MMC), a memory stick, etc. The external memory 934 may be functionally and/or physically connected to the electronic device 901 through various interfaces.

The sensor module 940 may measure, for example, a physical quantity or detect the operating state of the electronic device 901 and may convert the measured or detected information into an electrical signal. The sensor module 940 may include, for example, at least one of a gesture sensor 940A, a gyro sensor 940B, an atmospheric pressure sensor 940C, a magnetic sensor 940D, an acceleration sensor 940E, a grip sensor 940F, a proximity sensor 940G, a color sensor 940H (e.g., a red, green, blue (RGB) sensor), a biometric sensor 940I, a temperature/humidity sensor 940J, a light sensor 940K, and an ultraviolet (UV) sensor 940M. Additionally or alternatively, the sensor module 940 may include, for example, an e-nose sensor, an electromyography (EMG)

sensor, an electroencephalogram (EEG) sensor, an electrocardiogram (ECG) sensor, an infrared (IR) sensor, an iris sensor, and/or a fingerprint sensor. The sensor module 940 may further include a control circuit for controlling one or more sensors included therein. In various embodiments of the present disclosure, the electronic device 901 may further include a processor, which is configured to control the sensor module 940, as a part of the processor 910 or separate from the processor 910 in order to control the sensor module 940 while the processor 910 is in a sleep state.

The input device 950 may include, for example, a touch panel 952, a (digital) pen sensor 954, a key 956, or an ultrasonic input device 958. The touch panel 952 may be, for example, at least one of a capacitive type, a resistive type, an infrared type, and an ultrasonic type. Furthermore, the touch panel 952 may further include a control circuit. The touch panel 952 may further include a tactile layer to provide a tactile reaction to a user. The (digital) pen sensor 954 may include, for example, a recognition sheet that is a part of, or separate from, the touch panel 952. The key 956 may include, for example, a physical button, an optical key, or a keypad. The ultrasonic input device 958 may detect ultrasonic waves, which are generated by an input tool, through a microphone 988 to identify data corresponding to the detected ultrasonic waves.

The display 960 may include a panel 962, a hologram device 964, a projector 966, and/or a control circuit for controlling the same. The panel 962 may be implemented to be, for example, flexible, transparent, or wearable. The panel 962, together with the touch panel 952, may be configured as one or more modules. According to an embodiment of the present disclosure, the panel 962 may include a pressure sensor which may measure the strength of pressure of a user's touch. The pressure sensor may be implemented so as to be integrated with the touch panel 952, or may be implemented as one or more sensors separate from the touch panel 952. The hologram device 964 may show a three-dimensional image in the air using light interference. The projector 966 may display an image by projecting light onto a screen. The screen may be located, for example, in the interior of, or on the exterior of, the electronic device 901.

The interface 970 may include, for example, an HDMI 972, a USB 974, an optical interface 976, or a D-subminiature (D-sub) interface 978. The interface 970 may be included, for example, in the communication interface 170. Additionally or alternatively, the interface 970 may, for example, include a mobile high-definition link (MHL) interface, an SD card/MMC interface, or an Infrared Data Association (IrDA) standard interface.

The audio module 980 may convert, for example, sound into an electrical signal, and vice versa. At least some elements of the audio module 980 may be included, for example, in the input/output interface 150. The audio module 980 may process sound information that is input or output through, for example, a speaker 982, a receiver 984, earphones 986, the microphone 988, etc. The camera module 991 is a device that can photograph a still image and a moving image. According to an embodiment of the present disclosure, the camera module 991 may include one or more image sensors (e.g., a front sensor or a rear sensor), a lens, an ISP, or a flash (e.g., an LED or xenon lamp).

The power management module 995 may manage, for example, the power of the electronic device 901. According to an embodiment of the present disclosure, the power management module 995 may include a power management integrated circuit (PMIC), a charger IC, or a battery gauge. The PMIC may use a wired and/or wireless charging method. Examples of the wireless charging method may include a magnetic-resonance method, a magnetic-induction method, an electromagnetic-wave method, etc. Additional circuits (e.g., a coil loop, a resonance circuit, a rectifier, etc.) for wireless charging may be further included. The battery gauge may measure, for example, the remaining charge of the battery 996 and a voltage, current, or temperature while charging. The battery 996 may include, for example, a rechargeable battery and/or a solar battery.

The indicator 997 may display a particular state, for example, a booting state, a message state, a charging state, etc. of the electronic device 901 or a part (e.g., the processor 910) of the electronic device 901. The motor 998 may convert an electrical signal into a mechanical vibration and may generate a vibration, a haptic effect, etc. The electronic device 901 may include a mobile TV support device (e.g., GPU) that may process media data according to a standard such as digital multimedia broadcasting (DMB), digital video broadcasting (DVB), mediaFlo™, etc.

Each of the above-described component elements of hardware according to the present disclosure may be configured with one or more components, and the names of the corresponding component elements may vary based on the type of electronic device. The electronic device 901 may not include some elements, or may further include additional elements. Some elements may be coupled to constitute one object, but the electronic device may perform the same functions as those of corresponding elements before being coupled to each other.

Figure 10:
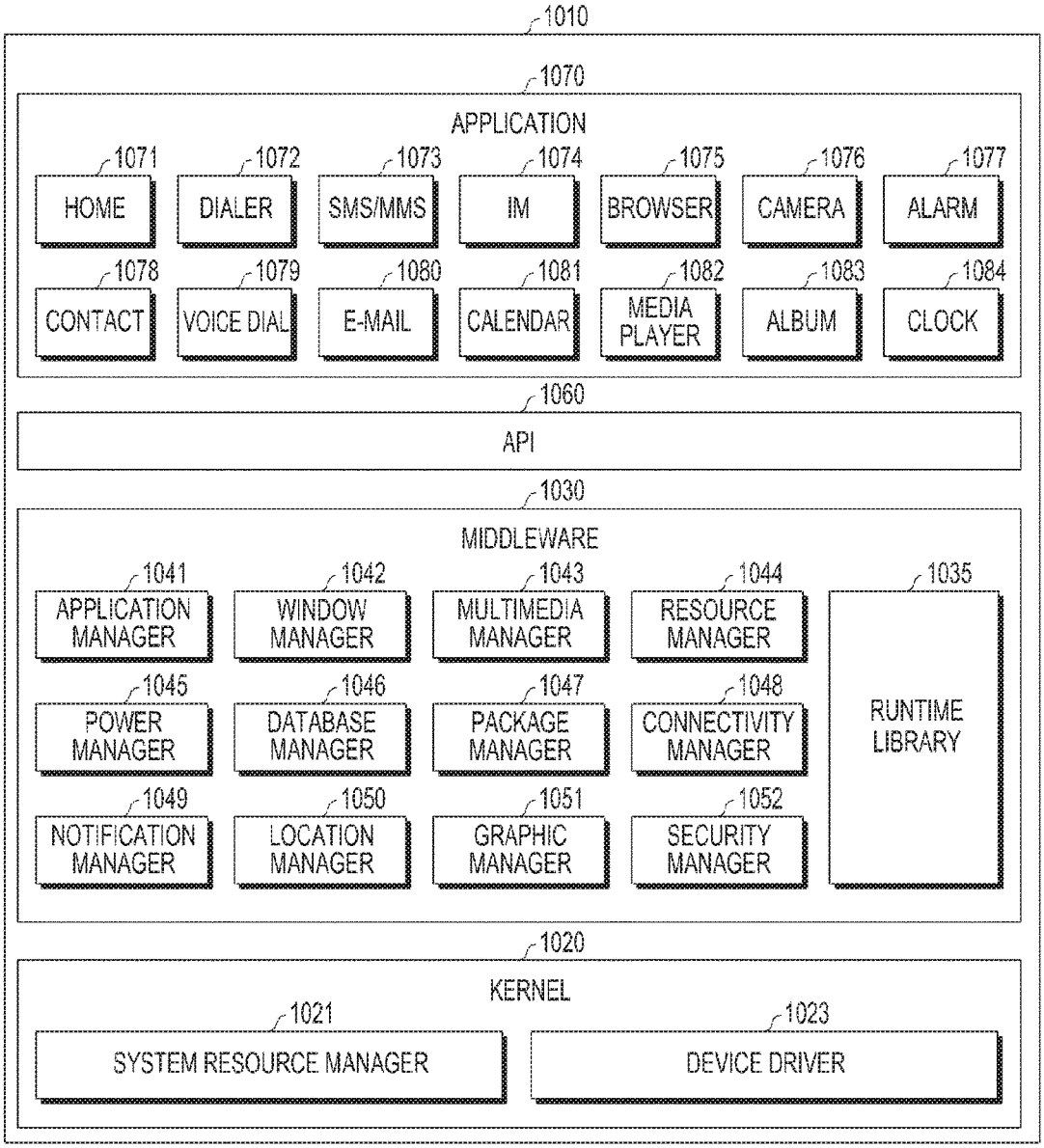
FIG. 10 is a block diagram illustrating a programming module according to various embodiments of the present disclosure.

FIG. 10 is a block diagram illustrating a program module according to various embodiments of the present disclosure. The program module 1010 may include an OS that controls resources relating to an electronic device 901 and/or various applications that are driven on the OS. The operating system may include, for example, Android™ iOS™, Windows™, Symbian™, Tizen™, or Bada™. Referring to FIG. 10, the program module 1010 may include a kernel 1020, middleware 1030, an API 1060, and/or applications 1070. At least a portion of the program module 1010 may be preloaded on the electronic device 901, or may be downloaded from an external electronic device (e.g. the electronic device 102 or 104, or the server 106).

The kernel 1020 may include, for example, a system resource manager 1021 and/or a device driver 1023. The system resource manager 1021 may control, allocate, or retrieve system resources. According to an embodiment of the present disclosure, the system resource manager 1021 may include a process manager, a memory manager, or a file system manager. The device driver 1023 may include, for example, a display driver, a camera driver, a Bluetooth™ driver, a shared memory driver, a USB driver, a keypad driver, a Wi-Fi driver, an audio driver, or an inter-process communication (IPC) driver.

The middleware 1030 may provide a function required by the applications 1070 in common, or may provide various functions to the applications 1070 through the API 1060 so that the applications 1070 can efficiently use the limited system resources within the electronic device. According to an embodiment of the present disclosure, the middleware 1030 may include at least one of a runtime library 1035, an application manager 1041, a window manager 1042, a multimedia manager 1043, a resource manager 1044, a power manager 1045, a database manager 1046, a package manager 1047, a connectivity manager 1048, a notification manager 1049, a location manager 1050, a graphic manager 1051, and a security manager 1052.

The runtime library 1035 may include, for example, a library module that a compiler uses in order to add a new function through a programming language while the applications 1070 are being executed. The runtime library 1035 may manage input/output, manage memory, or process arithmetic functions. The application manager 1041 may manage, for example, the life cycles of the applications 1070. The window manager 1042 may manage GUI resources used for a screen. The multimedia manager 1043 may identify formats required for reproducing various media files and may encode or decode a media file using a codec suitable for the corresponding format. The resource manager 1044 may manage source code of the applications 1070 or space in memory. The power manager 1045 may manage, for example, the capacity or power of a battery, and may provide power information required for operating the electronic device. According to an embodiment of the present disclosure, the power manager 1045 may operate in conjunction with a basic input/output system (BIOS). The database manager 1046 may, for example, generate, search, or change databases to be used by the applications 1070. The package manager 1047 may manage the installation or update of an application that is distributed in the form of a package file.

The connectivity manager 1048 may manage, for example, a wireless connection. The notification manager 1049 may provide an event (e.g., an arrival message, an appointment, a proximity notification, etc.) to a user. The location manager 1050 may manage, for example, the location information of the electronic device. The graphic manager 1051 may manage a graphic effect to be provided to a user and a user interface relating to the graphic effect. The security manager 1052 may provide, for example, system security or user authentication. According to an embodiment of the present disclosure, the middleware 1030 may include a telephony manager for managing a voice or video call function of the electronic device, or a middleware module that is capable of forming a combination of the functions of the above-described elements. The middleware 1030 may provide an OS-specific module. Furthermore, the middleware 1030 may dynamically remove some of the existing elements, or may add new elements. The API 1060 is, for example, a set of API programming functions, and may be provided with different configurations depending on the OS. For example, in the case of Android or iOS, one API set may be provided for each platform, and in the case of Tizen, two or more API sets may be provided for each platform.

The applications 1070 may include, for example, a home application 1071, a dialer application 1072, an SMS/MMS application 1073, an instant messaging (IM) application 1074, a browser application 1075, a camera application 1076, an alarm application 1077, a contact application 1078, a voice dial application 1079, an email application 1080, a calendar application 1081, a media player application 1082, an album application 1083, a clock application 1084, healthcare application (e.g., for measuring exercise quantity or blood glucose level), or an application providing environmental information (e.g., atmospheric pressure, humidity, or temperature information). According to an embodiment of the present disclosure, the applications 1070 may include an information exchange application that can support the exchange of information between the electronic device and an external electronic device. The information exchange application may include, for example, a notification relay application for relaying particular information to an external electronic device or a device management application for managing an external electronic device. For example, the notification relay application may relay notification information generated in the other applications of the electronic device to an external electronic device, or may receive notification information from an external electronic device and provide the received notification information to a user. The device management application may install, delete, or update the functions (e.g., turning on/off the external electronic device itself or some elements thereof, or adjusting the brightness or resolution of a display) of an external electronic device that communicates with the electronic device or applications executed in the external electronic device. The applications 1070 may include applications (e.g., a healthcare application of a mobile medical device) that are designated according to the attributes of an external electronic device. The applications 1070 may include applications received from an external electronic device. At least a portion of the program module 1010 may be implemented (e.g., executed) by software, firmware, hardware (e.g., the processor 910), or a combination of two or more thereof, and may include a module, a program, a routine, an instruction set, or a process for performing one or more functions.

The term "module" as used herein may include a unit consisting of hardware, software, or firmware, and may, for example, be used interchangeably with the term "logic", "logical block", "component", "circuit", etc. The "module" may be an integrated component, or a minimum unit for performing one or more functions or a part thereof. The "module" may be mechanically or electronically implemented and may include, for example, an application specific integrated circuit (ASIC) chip, a field programmable gate arrays (FPGA), or a programmable-logic device, which are known or are to be developed in the future, for performing certain operations. At least some of devices (e.g., modules or functions thereof) or methods (e.g., operations) according to various embodiments of the present disclosure may be implemented by an instruction which is stored a computer-readable storage medium in the form of a program module. The instruction, when executed by a processor (e.g., the processor 910), may cause the one or more processors to execute the function corresponding to the instruction. The computer-readable storage medium may include a hard disk, a floppy disk, a magnetic medium (e.g., a magnetic tape), an optical media (e.g., CD-ROM, DVD), a magneto-optical media (e.g., a floptical disk), an inner memory, etc. The instruction may include a code made by complier or code that can be executed by an interpreter. The programming module may include one or more of the aforementioned elements or may further include other additional elements, or some of the aforementioned elements may be omitted. Operations performed by a module, a programming module, or other elements may be executed sequentially, in parallel, repeatedly, or in a heuristic manner. At least some operations may be executed according to another sequence, may be omitted, or may further include other operations.

Various embodiments disclosed herein are provided merely to easily describe technical details of the present disclosure and to help the understanding of the present disclosure, and are not intended to limit the scope of the present disclosure. Accordingly, the scope of the present disclosure should be construed as including all modifications or various other embodiments based on the technical idea of the present disclosure as defined in the appended claims and their equivalents.

What is claimed is:

1. An electronic device comprising:

a housing;

a sensor module including a displacement sensor to measure a displacement of at least a portion of the housing;

an audio output module; and a processor configured to apply a preset DC offset to a sound signal provided to the audio output module based on a change in an internal pressure of the electronic device identified using the sensor module, wherein the change in the internal pressure includes the displacement measured through the displacement sensor falling outside of a preset reference change range.

2. The electronic device of claim 1, wherein the processor is further configured to stop applying the DC offset to the sound signal provided to the audio output module when the internal pressure of the electronic device changes to be less than a preset pressure value.

3. The electronic device of claim 1, wherein the audio output module comprises a diaphragm that vibrates according to the sound signal, a device for identifying a location of the diaphragm, and a location of a vibration starting point of the diaphragm changes depending on the DC offset.

4. The electronic device of claim 1, wherein the sensor module comprises a pressure sensor located within the electronic device to measure the internal pressure of the electronic device, and wherein the processor is further configured to apply the DC offset to the sound signal provided to the audio output module when the internal pressure of the electronic device, measured through a pressure sensor, falls outside of a preset reference pressure range.

5. The electronic device of claim 1, wherein the housing further includes a front case, to which a display panel of the electronic device is attached, and a rear case disposed on a rear surface of the electronic device, and wherein the displacement sensor is attached to the rear case to measure a displacement of the rear case.

6. The electronic device of claim 1, wherein the processor is further configured to identify the change in the internal pressure of the electronic device when a signal is output from the audio output module.

7. The electronic device of claim 1, further comprising a battery, wherein the processor is further configured to identify the change in the internal pressure of the electronic device when a state of charge of the battery is lower than a preset reference state of charge.

8. The electronic device of claim 1, wherein the sensor module comprises a grip sensor, and wherein the processor is further configured to identify the change in the internal pressure of the electronic device upon identifying that the electronic device is gripped using the grip sensor.

9. The electronic device of claim 1, wherein the sensor module comprises at least one of a gyro sensor and a proximity sensor, and wherein the processor is further configured to identify the change in the internal pressure of the electronic device when at least one of a bearing change of the electronic device and a presence of an object is identified using at least one of the gyro sensor and the proximity sensor.

10. The electronic device of claim 1, further comprising:

an input/output interface; and a communication interface, wherein the processor is further configured to identify the change in the internal pressure of the electronic device when a user input is received through the input/output interface to execute a call using the communication interface.

11. The electronic device of claim 1, further comprising an input/output interface, wherein the processor is further configured to identify the change in the internal pressure of the electronic device when user input for reproducing a media file is received through the input/output interface.

12. The electronic device of claim 1, wherein the processor is further configured to identify the change in the internal pressure of the electronic device using the sensor module by identifying a location of a diaphragm of the audio output module immediately before the sound signal is output from the audio output module.

13. A method of processing a sound signal by an electronic device including a housing, the method comprising:

identifying a change in an internal pressure of the electronic device using a sensor module including a displacement sensor to measure a displacement of the housing of the electronic device;

measuring the displacement through the displacement sensor, determining that the internal pressure of the electronic device changes when the measure displacement falls outside of a preset reference pressure range; and applying a preset DC offset to a sound signal provided to an audio output module of the electronic device based on the determined change in the internal pressure.

14. The method of claim 13, further comprising stopping the application of the DC offset to the sound signal provided to the audio output module when the internal pressure of the electronic device changes to be less than a preset pressure value.

15. The method of claim 13, wherein the audio output module comprises a diaphragm that vibrates according to the sound signal, and a location of a vibration starting point of the diaphragm changes depending on the DC offset.

16. The method of claim 13, wherein the sensor module comprises a pressure sensor located within the electronic device to measure the internal pressure of the electronic device, and wherein identifying the change in the internal pressure of the electronic device comprises:

measuring the internal pressure of the electronic device using the pressure sensor;

determining that the internal pressure of the electronic device changes, when the measured internal pressure falls outside of a preset reference pressure range; and applying the DC offset to the sound signal provided to the audio output module, when it is determined that the internal pressure of the electronic device changes.

17. The method of claim 13, wherein the housing includes a front case, to which a display panel of the electronic device is attached, and a rear case disposed on a rear surface of the electronic device, and wherein the displacement sensor is attached to the rear case to measure displacement of the rear case.

18. The method of claim 13, wherein the change in the internal pressure of the electronic device is identified when a signal is output from the audio output module.

19. The method of claim 13, wherein the change in the internal pressure of the electronic device is identified when a state of charge of a battery of the electronic device is lower than a preset reference state of charge.

20. The method of claim 13, wherein the sensor module comprises at least one of a gyro sensor and a proximity sensor, and wherein the change in the internal pressure of the electronic device is identified when at least one of a bearing change of the electronic device and a presence of an object is identified through at least one of the gyro sensor and the proximity sensor.

* * * * *